United States Patent [19]

Hofer

[11] Patent Number: 4,507,898

[45] Date of Patent: Apr. 2, 1985

[54] ABRASIVE LIQUID JET CUTTING APPARATUS

[75] Inventor: Peter H. Hofer, Barrington, Ill.

[73] Assignee: International Harvester Company, Chicago, Ill.

[21] Appl. No.: 424,939

[22] Filed: Sep. 28, 1982

Related U.S. Application Data

[62] Division of Ser. No. 253,440, Apr. 13, 1981, Pat. No. 4,380,138.

[51] Int. Cl.[3] ..... B24C 3/00

[52] U.S. Cl. ..... 51/410

[58] Field of Search ..... 51/410, 418, 428, 263, 51/319-321; 83/53, 177

[56] References Cited

U.S. PATENT DOCUMENTS

| | | | |
|---|---|---|---|
| 1,583,918 | 5/1926 | Dunn | 51/410 |
| 2,122,665 | 7/1938 | Twyning | 51/263 |
| 2,387,193 | 10/1945 | Swenarton | 51/321 |
| 2,448,316 | 8/1948 | Lesavoy | 51/418 |
| 2,985,050 | 5/1961 | Schwacha | 51/410 |
| 3,150,467 | 9/1964 | Umbricht et al. | 51/410 |
| 3,360,400 | 12/1967 | Evans et al. | 51/410 |
| 3,888,054 | 6/1975 | Maselli | 51/319 |
| 4,216,906 | 8/1980 | Olsen et al. | 83/177 |

*Primary Examiner*—Frederick R. Schmidt
*Assistant Examiner*—Robert A. Rose
*Attorney, Agent, or Firm*—Dennis K. Sullivan; F. David AuBuchon

[57] ABSTRACT

Abrasive liquid jet cutting is provided by disposing abrasive particles in positionally supported form, as on a carrier, such as sandpaper, between the liquid jet nozzle and the workpiece. The particles are intercepted by the liquid jet and driven into the workpiece which may be ferrous or nonferrous metal. The particles may be bonded to a paper-like backing, incorporated in a binder, such as a viscous paste, or formed into a rod-like structure. Variable feed of the workpiece or the abrasive carrier can be used to provide optimized or selective abrasive cutting.

13 Claims, 9 Drawing Figures

FIG. 1
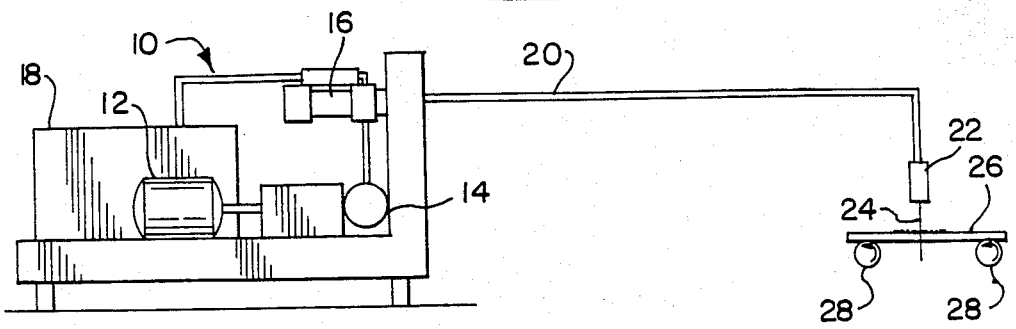
FIG. 2
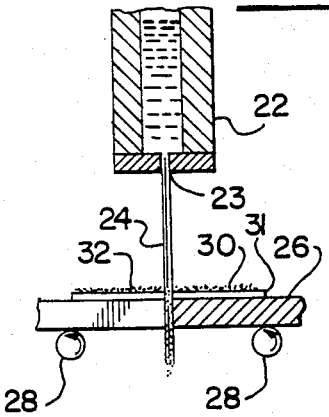
FIG. 3
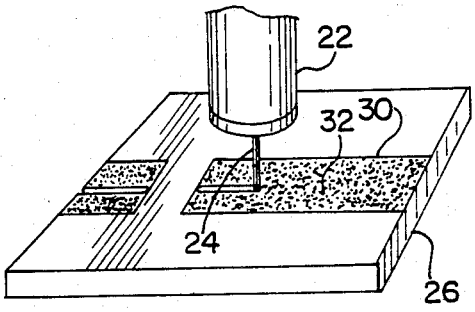
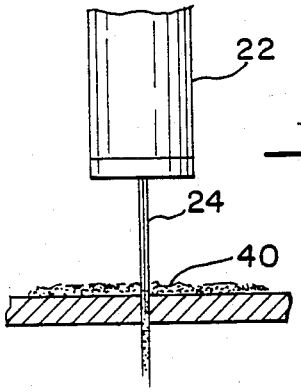
FIG. 4

ABRASIVE LIQUID JET CUTTING APPARATUS

This is a division of application Ser. No. 253,440, filed Apr. 13, 1981, now U.S. Pat. No. 4,380,138.

BACKGROUND OF THE INVENTION

This invention relates to high velocity liquid jet cutting or machining and more particularly, to methods and apparatus for introducing abrasive particles into liquid jets, commonly water jets, to enhance the cutting ability thereof. This produces the major advantage of enabling the liquid jet to cut through materials, especially ferrous and nonferrous metals, which generally cannot be cut using conventional water jet technology.

THE PRIOR ART

High velocity liquid jet cutting machines are well known in the art. The major components of these machines are a source of high pressure liquid, conduit means to carry the liquid to the area of cutting, and a carefully contoured nozzle assembly to receive the high pressure liquid from the conduit means and discharge the liquid through a small orifice as a small diameter, high velocity cutting jet traveling at supersonic speeds. One such machine is described in U.S. Pat. No. 3,997,111. These machines are frequently used to provide a clean dust free cut through most plastic and reinforced plastic materials, as well as through wood, hybrids, and fibrous materials. However, most ferrous and nonferrous metals having a thickness of more than a few thousands of an inch are not susceptible to liquid jet cutting. In the case of hybrid plastic parts having integrally molded metallic inserts, the inability of the liquid jet to penetrate the metal makes the use of this dust free trimming method impractical.

It is heretofore unknown to add abrasives to these high velocity liquid cutting jets, probably because the addition of significant amounts of abrasive to the liquid would result in destruction of the high pressure pumping equipment, the conduit, the nozzle assembly, and the orifice in very short order. Positioning loose particles on the workpiece in the path of the liquid jet would not be practical because the liquid splatter from the jet would wash away the particles from the path of the liquid jet.

SUMMARY OF THE INVENTION

The present invention broadly comprises an improved method and apparatus for liquid jet cutting wherein abrasive particles are interposed between the liquid jet nozzle and the workpiece in positionally supported relation, for example, bonded to a carrier such as sandpaper. The abrasive particles are intercepted by the liquid jet, and become entrained therewith, at least momentarily, and the particles are driven into the workpiece to effect a cutting action thereon. Several alternative methods or structures for holding the abrasive particles in relatively fixed position for interception by the liquid jet are within the contemplation of the invention. Among these are bonding the particles to a paper-like backing, incorporating the particles in a binder, such as a viscous paste, or forming the abrasive into a rod-like structure.

Further within the contemplation of the invention is that a variable feed mechanism either for the abrasive or for the workpiece can be utilized to vary the amount of abrasive added to the liquid jet depending on the nature and/or thickness of the workpiece to be cut. For example, when cutting the hybrid plastic part referred to above, the abrasive can be applied locally to only the metal insert.

DETAILED DESCRIPTION OF THE DRAWINGS

Other objects and advantages of the invention will become more apparent upon reading the detailed description thereof and upon reference to the drawings in which:

FIG. 1 is a schematic drawing of a liquid jet cutting apparatus of the type which might be used in practicing the invention;

FIG. 2 is an enlarged cross-sectional view of the nozzle and workpiece of FIG. 1 illustrating one embodiment of an abrasive carrier used to practice the invention;

FIG. 3 is an enlarged perspective view of the nozzle and workpiece of FIG. 1 illustrating multiple layers of abrasive carrier;

FIG. 4 is an enlarged view of the nozzle and workpiece similar to FIG. 2 and illustrating a different abrasive carrier;

DETAILED DESCRIPTION OF THE INVENTION

Figure 9:
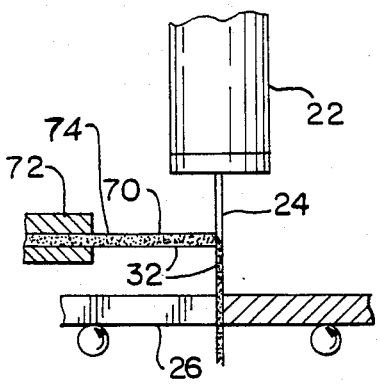
FIG. 9 is a drawing similar to FIG. 4 but illustrating the selective use of the abrasive carrier for abrasively cutting only selected portions of the workpiece.

Turning to the drawings, there is shown in FIG. 1 a liquid jet cutting apparatus generally designated 10 which includes an electric motor 12 which drives a hydraulic pump 14, which in turn supplies working liquid to a high pressure intensifier unit 16. The intensifier 16 draws liquid, that is a specially prepared deionized water, from a suitable source, such as reservoir 18 and discharges the water at a very high pressure, on the order of 400 MPa (58,000 psi), through a conduit 20. Mounted on the discharge end of the conduit 20 is a discharge assembly or nozzle 22 which provides a very high velocity, small diameter liquid cutting jet 24 which is directed at a workpiece 26. It will be appreciated that the nozzle assembly 22 could be hand held or mounted on additional unshown apparatus, for example, on the arm of an industrial robot. In FIG. 2, which shows a schematic cross section of the nozzle 22, it can be seen that high pressure liquid is expelled through a very small orifice 23 having a diameter on the order of a few tenths of a millimeter to produce a relatively thin liquid jet of high velocity, that is, supersonic on the order of about 900 meters (3,000 ft.) per second. Reference is hereby made to U.S. Pat. No. 3,997,111 for a more complete description of such a liquid jet cutting apparatus.

There is further shown schematically in FIGS. 1 and 2 a means for effecting relative movement between the liquid jet 24 and the workpiece 26 comprising conventional feed rollers 28 beneath the workpiece. It will be realized that any suitable feed mechanism may be used and, for some cutting operations, such as drilling holes, may not be necessary.

In accordance with the invention, means are provided for interposing abrasive particles between the liquid jet nozzle 22 and the workpiece 26 in positionally supported relation for interception of the particles by the liquid jet 24, that is the abrasive particles are not loose or significantly movable relative to each other due to normally occurring external influences associated with liquid jet cutting, such as splatter, prior to their interception by the liquid jet. As shown in FIGS. 2 and 3, this means takes the form of an abrasive carrier 30 comprising a backing sheet 31 of easily cut paper-like material having abrasive particles 32 bonded thereto, such as abrasive paper, disposed in overlying adjacent relation to the workpiece 26. With the abrasive particle carrier 30 thus disposed on top of the workpiece and upon actuation of the liquid jet apparatus 10, the liquid jet 24 will intercept the abrasive particles 32 on the carrier 30 momentarily entrain them and drive them to cut through the backing sheet 31. The particles 32 and liquid jet 24 then produce an abrasive cutting action against the workpiece 26 resulting in a relatively clean, burr-free cut.

For a given material and thickness of the workpiece, one can easily optimize the particular type of abrasive, the particle size, and its density on the carrier 30 as well as the cutting speed. For example, a 1.3 mm thick piece of tempered aluminum sheet having one 80 grit piece of regular sandpaper disposal on top was not completely severed by the liquid jet. However, using two layers of this sandpaper, as shown in FIG. 3, a relatively clean complete cut was obtained. It was also found that increasing the cutting speed was advantageous since at slower speeds, the liquid jet dissolved the glue on the abrasive paper and the splatter of liquid flushed aside the abrasive. In another test, using two sheets of 320 mesh grit wet and dry sandpaper, two 1.3 mm thick pieces of tempered aluminum were able to be cut. Whether the abrasive particle side of the sandpaper was facing toward the nozzle or toward the workpiece made no difference in the cutting action or in the cleanliness of the cut.

In FIG. 4, an alternative embodiment of the abrasive carrier is shown wherein the abrasive particles are incorporated into a binder or paste 40 which may be brushed or painted onto the surface of the workpiece by any conventional means. The paste 40 may be relatively thin and required to dry in order to fix the position of the abrasive particles relative to the workpiece prior to cutting or it may be a viscous paste which would provide sufficient fixing of the position of the abrasive particles to permit cutting without drying, the latter being more preferable in a continuous machining operation. As shown in FIG. 4, the paste 40 could be applied to the workpiece as a small dab to facilitate drilling a hole.

Figure 5:
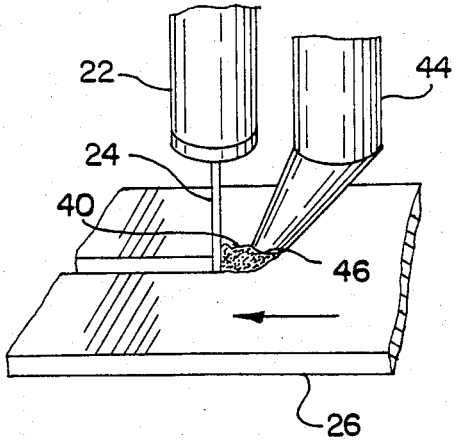
FIG. 5 is an enlarged view of the nozzle and workpiece similar to FIG. 2 and illustrating yet a different abrasive carrier.
Figure 6:
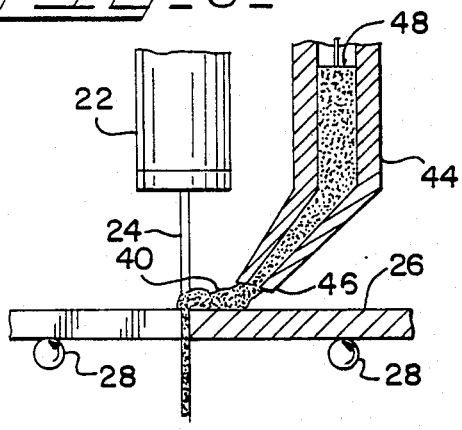
FIG. 6 is a perspective view similar to FIG. 3 but schematically illustrating an apparatus for depositing the abrasive carrier on the workpiece.

In FIGS. 5 and 6, the viscous paste 40, which could also be a slurry, is applied to the moving workpiece 26 from a second abrasive carrier nozzle 44 having an outlet 46 adjacent the liquid jet 24 on the side upstream in the direction of relative movement between the workpiece and the liquid jet. Any common means such as a piston 48 may be used to pressurize the paste 40 and extrude it in a viscous bead from the second nozzle 44 for movement of the bead and workpiece into the path of the liquid jet 24. Adjustment of the size of the nozzle opening 46 and/or control of the abrasive paste feed mechanism 48 can control the amount of abrasive intercepted by the liquid jet for a given increment of workpiece and thus optimize cutting and workpiece speeds and feeds.

Figure 7:
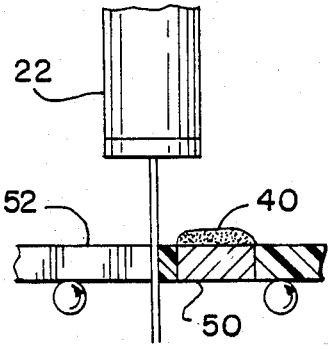
FIG. 7 is a cross-sectional view of the nozzle, workpiece, and abrasive carrier nozzle of FIG. 6 taken along the line of cut.

In FIG. 7, there is shown a metal insert 50, which is made of a material normally impervious to a liquid jet, disposed within a plastic workpiece 52 normally cuttable by a liquid jet. In this embodiment, it will be seen that a small amount of abrasive paste 40 can be disposed on the workpiece 52 only in the area of the metal insert 50 in order to achieve total cutting of the entire workpiece. Similarly, as shown in FIG. 3, the metal workpiece 26 can have the abrasive carrier removed from a section to permit selective cutting of only the other portions of the workpiece while continuing the liquid jet stream 24 and the workpiece feed without interruption.

Figure 8:
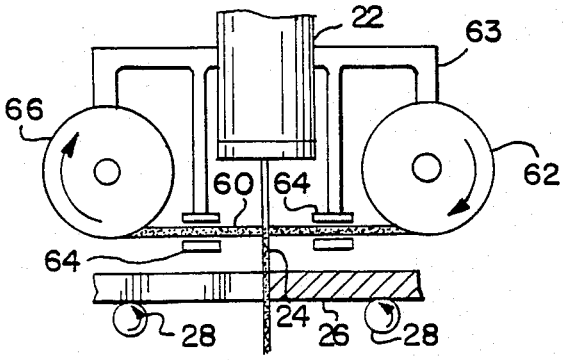
FIG. 8 is an enlarged section similar to FIG. 2 but illustrating still another apparatus for introducing abrasive particles into the liquid jet.

In FIG. 8, the abrasive particle carrier consists of an elongated tape or strip of backed abrasive 60 which is disposed in roll form 62 on a frame 63 attached to the nozzle 22 or a supporting framework therefor. The strip 60 is disposed to pass longitudinally through the liquid jet 24, being guided to that end by strip guides 64 and taken up by a reel 66 also mounted on the framework 63. Any conventional drive means may be used to turn the reels 62 and 66 to move the strip through the liquid jet. It will also be seen that by controlling the speed at which the strip 60 moves through the liquid jet, the amount of abrasive entrained by the jet can be controlled. Moreover, if the strip 60 is stopped non-abrasive cutting of the workpiece 26 can take place. Also, the workpiece 26 can be selectively cut by selective control of the feed of the tape or strip 60.

In FIG. 9, the abrasive particles 32 are formed into a rod 70 fed from a conventional rod feed means 72 into the liquid jet stream 24 so that the particles become entrained in the liquid jet and cut the workpiece 26. The rod 70 could be formed by compressing the particles, with or without a binder, or by enclosing the particles 32 in sausage fashion within an easily cuttable skin 74. By controlling the rate of rod feed, and/or the diameter of the rod 70, the amount of abrasive necessary to cut the workpiece can be optimized.

In operation, abrasive particles 32 are interposed between the nozzle on the workpiece in positionally fixed relation. A high velocity relatively thin liquid jet 24 is generated from the nozzle 22 and is directed to intercept the abrasive particles 32 and entrain them, at least momentarily, and drive them into the workpiece 26 effecting the cutting thereof. The abrasive particles 32 may be held in relatively fixed position by joining them with an expendable carrier 30, 40, 60, or 70 disposed between the nozzle and workpiece for interception by the liquid jet utilizing any of several methods including bonding the particles to a paper-like backing, such as abrasive paper, incorporating the particles in a binder, such as a viscous paste, or forming the abrasive particles into a rod-like structure. Linear cutting of the workpiece is produced by effecting relative movement between the liquid jet 24 and the workpiece 26 as by a standard workpiece feed mechanism. Depending on the carrier used for the abrasive particles, the abrasive particle density can be adjusted for a given workpiece material and thickness by the use of multiple layers or increased thickness of the carrier, or increasing the feed rate of the carrier into the liquid jet as well as by altering the density of the particles relative to the carrier which may be less practical in industrial cutting operations. The abrasive may also be selectively interposed to produce abrasive cutting of only those portions of the workpiece requiring it, as in cutting hybrid plastic parts having metal inserts.

Thus, there has been described in accordance with the invention, a method and apparatus for abrasive liquid jet cutting which fully solve the problems set forth above and provides the advantages thereat described. It is to be understood that in view of the broad nature of the inventive concept, those of skill in the art will readily recognize many modifications, alternatives, and variations to the specific embodiments and methods described. Accordingly, it is intended to embrace all such modifications, alternatives, and variations as fall within the spirit and broad scope of the appended claims.

What is claimed is:

1. Apparatus for generating abrasive liquid cutting jet comprising:

a nozzle;

means for generating a high velocity, relatively thin liquid jet from said nozzle; and an abrasive particle carrier comprising a thin solid layer of material having a plurality of abrasive particles bonded to a surface thereof, said carrier being disposed for penetration by said liquid jet such that said abrasive particles are at least momentarily entrained with said liquid jet.

2. The apparatus in accordance with claim 1 and said material being of a type easily cut by said liquid jet without the use of abrasive materials.

3. The apparatus in accordance with claim 2 and said material being paper.

4. The apparatus in accordance with claim 1 and wherein said carrier is an elongated strip of said material further comprising feed means for moving said strip lengthwise through said liquid jet.

5. The apparatus in accordance with claim 4 wherein said strip is in the form of a roll and means for mounting said roll adjacent said nozzle.

6. The apparatus in accordance with claim 5 and a frame positionally associated with said nozzle, said roll being mounted on said frame for movement relative to a workpiece.

7. The apparatus in accordance with claim 4 and said feed means being capable of moving said strip intermittently.

8. Apparatus for generating an abrasive liquid cutting jet comprising:

a nozzle;

means for generating a high velocity, relatively thin liquid jet from said nozzle; and an abrasive particle carrier comprising a rod having a plurality of abrasive particles joined thereto and means for advancing an end of said rod into said liquid jet, said rod being disposed for penetration by said liquid jet such that said abrasive particles are at least momentarily entrained with said liquid jet.

9. Apparatus for cutting a workpiece with a liquid jet comprising:

a liquid jet nozzle;

means for effecting relative movement between said nozzle and the workpiece;

means for generating a relatively thin, high velocity liquid jet from said nozzle;

a second nozzle having an outlet disposed adjacent said liquid jet in the direction of said relative movement;

means for extruding a slurry containing abrasive particles from said second nozzle onto said workpiece such that, upon said relative movement occurring, said liquid jet intercepts said particles and drives them into said workpiece.

10. Apparatus for cutting a workpiece with a liquid jet comprising:

a liquid jet nozzle;

means for generating a high velocity, relatively thin liquid jet from said nozzle;

a coating containing abrasive particles;

means for applying said coating to said workpiece such that said particles become positionally supported thereon; and means for effecting relative movement of said nozzle and said workpiece such that said liquid jet intercepts said particles.

11. The apparatus in accordance with claim 10 and said coating comprising a viscous paste containing said particles.

12. The apparatus in accordance with claim 11 and means for depositing said paste in a bead on said workpiece.

13. Apparatus for generating an abrasive liquid cutting jet comprising:

a source of high pressure liquid;

a nozzle connected by conduit means to said high pressure liquid source, said nozzle having a small orifice for emitting a directed, supersonic velocity, relatively pure and narrow airborne liquid jet;

a plurality of abrasive particles; and means for holding said particles in positionally supported relation, said holding means being cut by said airborne liquid jet and a portion of said particles being intercepted by said airborne liquid jet and driven thereby in the same direction therewith as a focused abrasive liquid jet, and said means for holding said particles comprising a paper-like material to which said particles are attached.

* * * * *